US005213634A

United States Patent [19]

DeArdo et al.

[11] Patent Number: 5,213,634

[45] Date of Patent: May 25, 1993

[54] MULTIPHASE MICROALLOYED STEEL AND METHOD THEREOF

[76] Inventors: Anthony J. DeArdo, 205 Mairfair Dr., Pittsburgh, Pa. 15228; C. Isaac Garcia, 122 Fenwick Dr., Pittsburgh, Pa. 15235; Roger M. Laible, R.D. 5-343A, Johnstown, Pa. 15905

[21] Appl. No.: 682,431

[22] Filed: Apr. 8, 1991

[51] Int. Cl.[5] ..... C21D 8/00; C22C 38/26

[52] U.S. Cl. ..... 148/334; 148/654

[58] Field of Search ..... 420/110; 148/334, 654

[56] References Cited

U.S. PATENT DOCUMENTS

| | | | |
|---|---|---|---|
| 2,158,651 | 5/1939 | Becket et al. | 420/110 |
| 2,194,178 | 3/1940 | Becket et al. | 420/110 |
| 2,264,355 | 12/1941 | Becket et al. | 420/104 |
| 3,010,822 | 11/1961 | Altenburger et al. | 420/127 |
| 3,102,831 | 9/1963 | Tisdale | 420/127 |
| 3,424,576 | 1/1969 | Fogelman et al. | 420/110 |
| 3,494,765 | 2/1970 | Gondo et al. | 420/127 |
| 3,807,990 | 4/1974 | Gohda et al. | 420/127 |
| 3,981,752 | 9/1976 | Kranenberg et al. | 148/12 B |
| 4,300,598 | 11/1981 | Royer et al. | 420/123 |
| 4,502,897 | 3/1985 | Morita et al. | 148/334 |
| 4,671,827 | 6/1987 | Thomas et al. | 148/12 E |
| 4,824,492 | 4/1989 | Wright | 148/12.4 |

FOREIGN PATENT DOCUMENTS

| | | | |
|---|---|---|---|
| 0095362 | 9/1970 | France | 148/334 |
| 53-51115 | 5/1978 | Japan | 148/12 F |
| 55-34659 | 3/1980 | Japan | 148/12 F |
| 56-123324 | 9/1981 | Japan | 148/12 F |
| 58-204159 | 11/1983 | Japan | 148/334 |

OTHER PUBLICATIONS

Garcia et al., "An Alternative Approach to the Alloy Design and Thermo-Mechanical Processing of Low--Carbon Microalloyed Bar Products," 1987 Mechanical Working and Steel Processing Proceedings, pp. 79-86.

Garcia et al., "Optimizing Strength and Toughness in Low Carbon Micro-Alloyed Bar Products", 8th PTD Conference Proceedings, 1988, pp. 59-64.

A. J. DeArdo., "An Overview of Microalloyed Steels", 8th PTD Conference Proceedings, 1988, pp. 67-78.

A. J. DeArdo et al., Round Table Discussion, in 8th PTD Conference Proceedings, 1988, pp. 89-93.

"New Options in Automotive Steels", Automotive Engineering, May 1989, pp. 71-79.

D. J. Naylor, "Review of international activity on microalloyed engineer steels", Ironmaking and Steelmaking, 1989, vol. 16, No. 4, pp. 246-252.

H. Kanisawa et al., "Development of wire rod with low flow stress for non-heat-treated fasteners", Wire Journal International, Apr. 1990 pp. 32-37.

The Update, published by NPC International, No. 1, Dec. 1989, pp. 1-6.

*Primary Examiner*—Deborah Yee

*Attorney, Agent, or Firm*—Gregory Garmong; John Iverson

[57] ABSTRACT

A steel of particular utility in forging applications has a composition, in weight percent, of from about 0.05 to about 0.35 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities. The steel may be worked in the austenite region to produce a well-conditioned austenite structure, cooled to transform the microstructure to a mixture of ferrite and bainite, and then cold forged to a final form. The steel may also be hot forged without first producing the well conditioned austenite. Heat treating of the final product is not required.

16 Claims, 5 Drawing Sheets

MULTIPHASE MICROALLOYED STEEL AND METHOD THEREOF

BACKGROUND OF THE INVENTION

This invention relates to steels and to a multiphase microalloyed steel having particular utility in long product (e.g., bar, rod, and wire) applications.

Forging is a commercially important method of producing finished or semi-finished steel products, wherein a piece of steel is deformed in compression into desired shapes. Forging may be accomplished with a wide range of processes. The steel may be heated to and forged at a high temperature, or forging may be accomplished at ambient temperature. The steel may be deformed continuously or with repeated blows. The steel may be formed without a die, or in a closed die to obtain closer tolerances of the final part. Steel forgings range in size from less than one pound to many tons in size, and hundreds of thousands of tons of steel are forged each year.

Until the 1970s, the vast majority of cold-forged and hot-forged steel forgings were made using "plain carbon" or low alloy steels with a carbon content selected to yield a combination of forgability and final properties. High strength forgings usually contain medium carbon contents of about 0.2–0.5 weight percent. This carbon content is required to permit the forging to be heat treated to the required strength through a post-forging heat treatment. While the moderately high carbon content is beneficial from the standpoint of achieving high strengths in the heat-treated condition, it also results in cold ductility and toughness that are insufficient for many requirements. Therefore, when these steels are to be supplied in cold forging applications, they must be subjected to a spheroidizing anneal prior to the cold deformation. Hence, until the early 1970s, the steels available for these high strength, hot and cold forging applications were medium carbon steels which could be heat treated to adequate strength levels at a very high cost of production, which included the spheroidizing anneal and stress relieving treatments.

In the early 1970s, attempts were made to reduce the cost of producing high strength hot forgings through the use of medium carbon microalloyed steels. Since these steels develop precipitation hardened ferrite-pearlite structures in the as-forged condition, they can achieve yield strengths of 85–90,000 pounds per square inch without the need for post-forging heat treatments. Unfortunately, these ferrite-pearlite steels exhibit low ductility and toughness and therefore are not usable in cold forging or applications requiring acceptable toughness such as safety-related items including striker bolts, steering knuckles, and center links in automobiles, and fasteners and other non-automotive applications.

End users' concerns for stronger, tougher, and more cost effective steels cannot be satisfied by either the quench and temper steels because they are too expensive, or the ferrite-pearlite steels because they have insufficient properties. Although medium carbon microalloyed steels are now used in some forgings, there remains the problem of insufficient strength and toughness in the forged components, particularly in safety-related applications. A new alloy design is required for optimization of performance and cost in particular kinds of applications. The present invention fulfills this need, and further provides related advantages.

SUMMARY OF THE INVENTION

The present invention provides an optimized multiphase microalloyed steel composition, microstructure, and processing for hot or cold forming as well as other applications such as extrusion or drawing. The steel achieves a good balance of excellent strength and toughness properties in the final components, whether processed by hot or cold deformation. The processing of semi-finished products can be accomplished in existing mill machinery on a commercial scale. One benefit of these new steels is that they develop high strength and toughness properties without the need for a post-forming heat treatment. The high ductility in the semi-finished form precludes the need for a spheroidizing anneal prior to the cold deformation processing.

In accordance with the invention, a steel composition of matter consists essentially of, in weight percent, from about 0.05 to about 0.35 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities. A preferred steel composition has about 0.10 percent carbon if it is to be hot forged or cold forged (or formed) and not induction hardened, or about 0.25 percent carbon if it is to be hot forged and induction hardened. The preferred steel further has about 1.0 percent manganese, about 0.8 percent molybdenum, about 0.5 percent chromium, about 0.05 percent niobium, about 0.007 percent nickel, and about 0.36 percent silicon.

To prepare it for cold forming, cold forging, and extrusion applications, the steel is preferably processed by continuous control rolling to a microstructure of ferrite and bainite, most preferably lower bainite. The ferrite preferably comprises from about 75 to about 90 volume percent of the steel, and the bainite the remainder. Small amounts of other phases such as pearlite may be present, but preferably not in excess of about 2 volume percent.

In preparation for cold forming, the steel composition is processed by working in the austenite range to produce a conditioned austenite structure. It is then cooled to transform the austenite to an appropriate microstructure, most preferably a fine grained ferrite structure with lower bainite distributed in islands throughout the ferrite. The selected composition cooperates with the processing to produce the desired final structure.

If the steel is to be used in hot forged products, the structure attained prior to forging is less important. Instead, the critical structure is that developed upon cooling after hot forging. A bainite-martensite structure is produced in these steels upon cooling from hot forging operations. An optimum microstructure for high strength in hot forged products is 80 percent by volume autotempered lath martensite and 20 percent by volume lower bainite.

The present invention represents a significant advance in the art of steels, and particularly for use in forging applications. The steel of the invention may be hot, warm, or cold forged with excellent resulting properties and without the need for post-forging heat treatments. Other features and advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
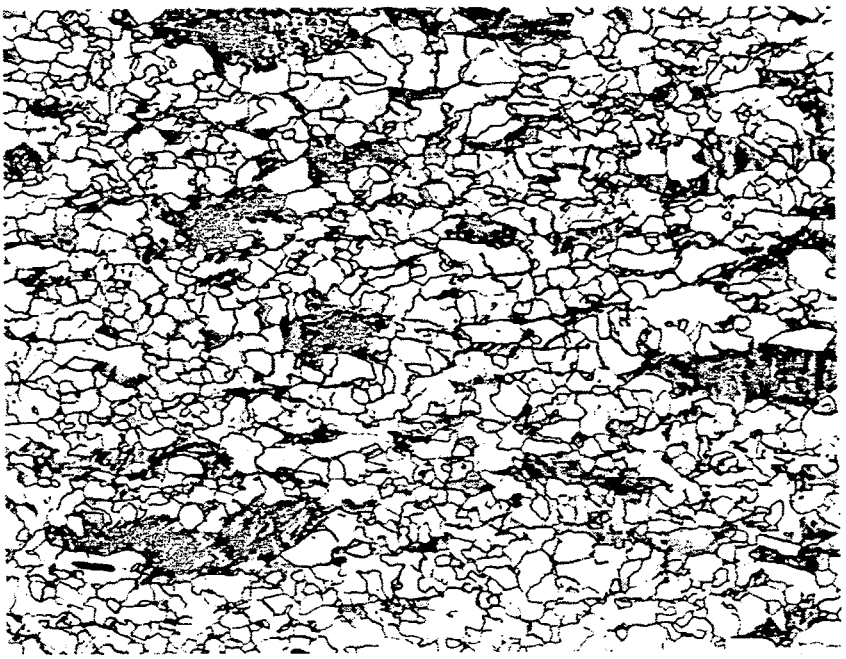
FIG. 1 is a micrograph (at 500X) of a sample processed by controlled rolling and air cooling.

There are two preferred embodiments of the invention, one for use in cold forming (including cold forging) and the other for use in hot forging, either with or without subsequent induction hardening or other surface treatment.

In accordance with the invention as applied to cold forming applications, a steel has a composition consisting essentially of, in weight percent, from about 0.05 to about 0.15 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities, and a microstructure consisting essentially of from about 15 to about 90 volume percent ferrite and the remainder lower bainite.

More preferably, the steel used for cold forging applications has a composition of from about 0.08 to about 0.12 percent carbon, from about 0.96 to about 1.05 percent manganese, from about 0.6 to about 1.0 percent molybdenum, from about 0.4 to about 0.75 percent chromium, from about 0.03 to about 0.07 percent niobium, from about 0.006 to about 0.01 percent nitrogen, and from about 0.2 to about 0.4 percent silicon. Most preferably, the steel has a composition of about 0.10 percent carbon, about 1.0 percent manganese, about 0.8 percent molybdenum, about 0.5 percent chromium, about 0.05 percent niobium, about 0.003 percent sulfur, about 0.007 percent nitrogen, and about 0.36 percent silicon.

The steel for use in cold forming applications is hot worked in the austenite range and cooled at a rate sufficient to produce a ferritic-bainitic microstructure with an average ferrite grain size of less than about 15 micrometers. It is then cold formed by any operable cold forming process.

In accordance with the invention as applied to hot forging applications, a steel consists essentially of, in weight percent, from about 0.05 to about 0.35 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities, and a microstructure consisting essentially of from about 70 to about 90 volume percent lath martensite and from about 10 to about 30 volume percent lower bainite.

There are two preferred embodiments of the hot forging grade of this steel, one used when the article is to be induction hardened and the other when the article is not to be induction hardened. The induction hardened steel preferably has a carbon content of from about 0.15 to about 0.35 percent, most preferably 0.25 percent, and the non-induction hardened steel preferably has a carbon content of from about 0.08 to about 0.15 percent, most preferably 0.10 percent. In both cases, the preferred ranges for the remainder of the elements are the same, and are also the same as for the preferred and most preferred ranges of the steel to be used for cold forging applications.

In all cases, the steel may have amounts of minor elements conventionally found in commercial steelmaking practice. Among these elements, the boron content is desirably from about 0.0005 to about 0.002 percent, most preferably about 0.0015 percent. The titanium content is desirably from about 0.005 to about 0.04 percent, most preferably about 0.015 percent.

All of the steels are manufactured by conventional practices. They may be prepared by melting the elements together in a furnace, or by refining operations in basic oxygen, open hearth, or electric furnaces.

In a particularly preferred embodiment that can be used for both cold forming and hot forging (non-induction hardened) applications, a steel (termed MPC steel) was prepared with a composition of 0.10 percent carbon, about 1.00 percent manganese, about 0.70 percent molybdenum, about 0.50 percent chromium, about 0.05 percent niobium, about 0.020 sulfur, about 0.007 percent nitrogen, about 0.30 percent silicon, about 0.01 percent phosphorus, about 0.04 percent aluminum, balance iron plus minor impurities. Heats of this steel were made in an electric arc furnace, cast into ingots, and conventionally rolled into billets ranging in cross section from 4-½ inches square to 6-¾ inches square and lengths ranging from 18 to 54 feet.

When the steel is to be used in cold forming applications, it is important that the austenite be well conditioned prior to cooling transformation. In this context, "well conditioned" austenite has a fully recrystallized, equiaxed, fine grain structure, with the grain size preferably about 10–15 micrometers in diameter on average.

To achieve a well conditioned austenite microstructure, some of the billets were rolled according to the following control rolling schedule. The billets were reheated to 2200° F. (+/−50° F.) and held at the reheat temperature for an aim minimum time of 30 minutes. Control rolling occurred in the range of 1525°–1650° F. In the control rolling, the final reduction reduced the area of the bar by a factor of two. The final reduction was achieved in the finishing stands, with 4–8 passes. The control rolling schedule was accomplished using a rolling mill and procedure such as that described in U.S. Pat. No. 3,981,752, whose disclosure is incorporated by reference. The steel was then cooled from the austenite range by air cooling or water quenching, to produce a range of microstructures in the different specimens. The control rolled and air cooled material was used for subsequent cold forging, without any pre-forging annealing or post-forging quenching and tempering.

FIG. 1 illustrates the microstructure obtained by controlled rolling in the austenite range and then air cooling. The microstructure consists of approximately 75–80 percent polygonal ferrite and 20–25 percent of uniformly distributed islands of lower bainite.

Other billets were rolled with conventional rolling practice in the austenite range as follows: reheat the billets to approximately 2200° F., and roll the billet in a series of 22 passes to a finishing temperature of approximately 1750° F. The rolled bar was air cooled. The conventionally rolled billets were used for subsequent hot and warm forging.

Figure 2:
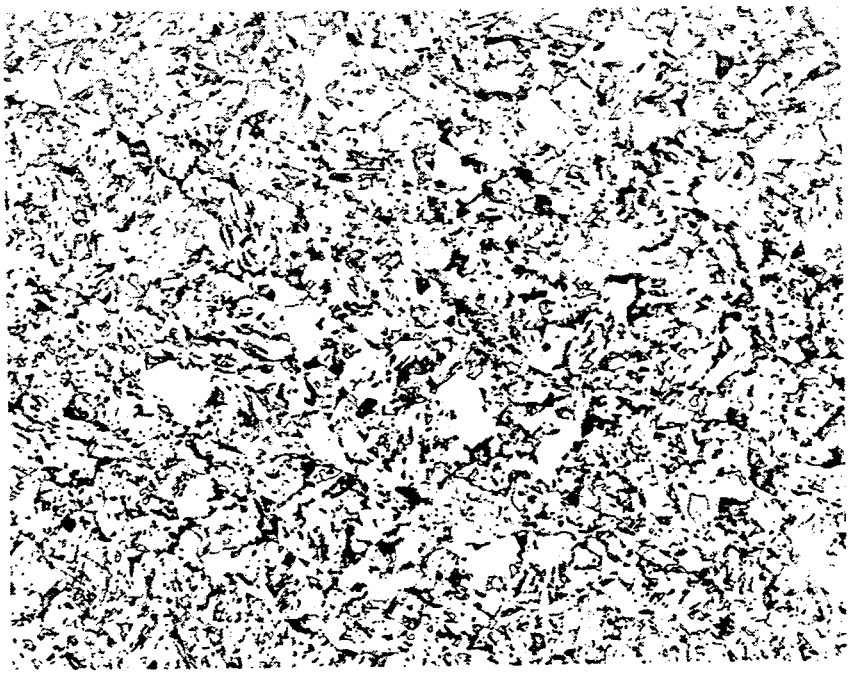
FIG. 2 is a micrograph (at 500X) of a sample processed by conventional hot rolling and air cooling.

FIG. 2 illustrates the microstructure obtained by conventional rolling and air cooling. The microstructure consists of approximately 50–65 percent polygonal ferrite, 35–45 percent upper bainite, and 2–5 percent pearlite. A comparison of FIGS. 1 and 2 indicates that the major differences between the microstructures obtained after conventional rolling and after control rolling are the amount of polygonal ferrite (58 percent in conventional rolling versus 77 percent in control rolling), and the type, amount, and morphology of the bainite phase.

The steel of the invention is operable with the alloying elements varying over particular ranges. In the following discussion of those ranges and the consequences of not maintaining an element within the stated range, the other elements are maintained within their stated ranges. The present steel achieves its desirable properties as a result of a combination of elements, not any one element operating without regard to the others. Thus, the selection and amounts of the alloying elements are interdependent, and cannot be optimized without regard to the other elements present and their amounts. Within the context of the entirety of the composition of the steel, the alloying elements and their operable percentages are selected for the reasons set forth in the following paragraphs.

The carbon content can vary from about 0.05 to about 0.35 weight percent. Carbon forms carbides and also contributes to the formation of the bainite phase. Increasing amounts of carbon increase the strength of the steel but also decrease its ductility and toughness. If the amount of carbon is less than about 0.05 percent, the yield strength of the steel is too low and expensive elements must be added to increase the yield strength. If the amount of carbon is greater than about 0.35 percent, the ductility of the steel is too low. Within this broad range, the grade of steel for use in cold forging has about 0.08–0.12 percent carbon, most preferably 0.10 carbon, to produce the desired microstructure. The grade of steel for use in hot forging, without subsequent induction hardening, has about 0.08–0.15 percent carbon, most preferably 0.10 percent carbon. If the steel is to be hot forged and then induction hardened, the carbon content is increased to about 0.15–0.35 percent, most preferably 0.25 percent, to permit the induction hardening.

Figure 3:
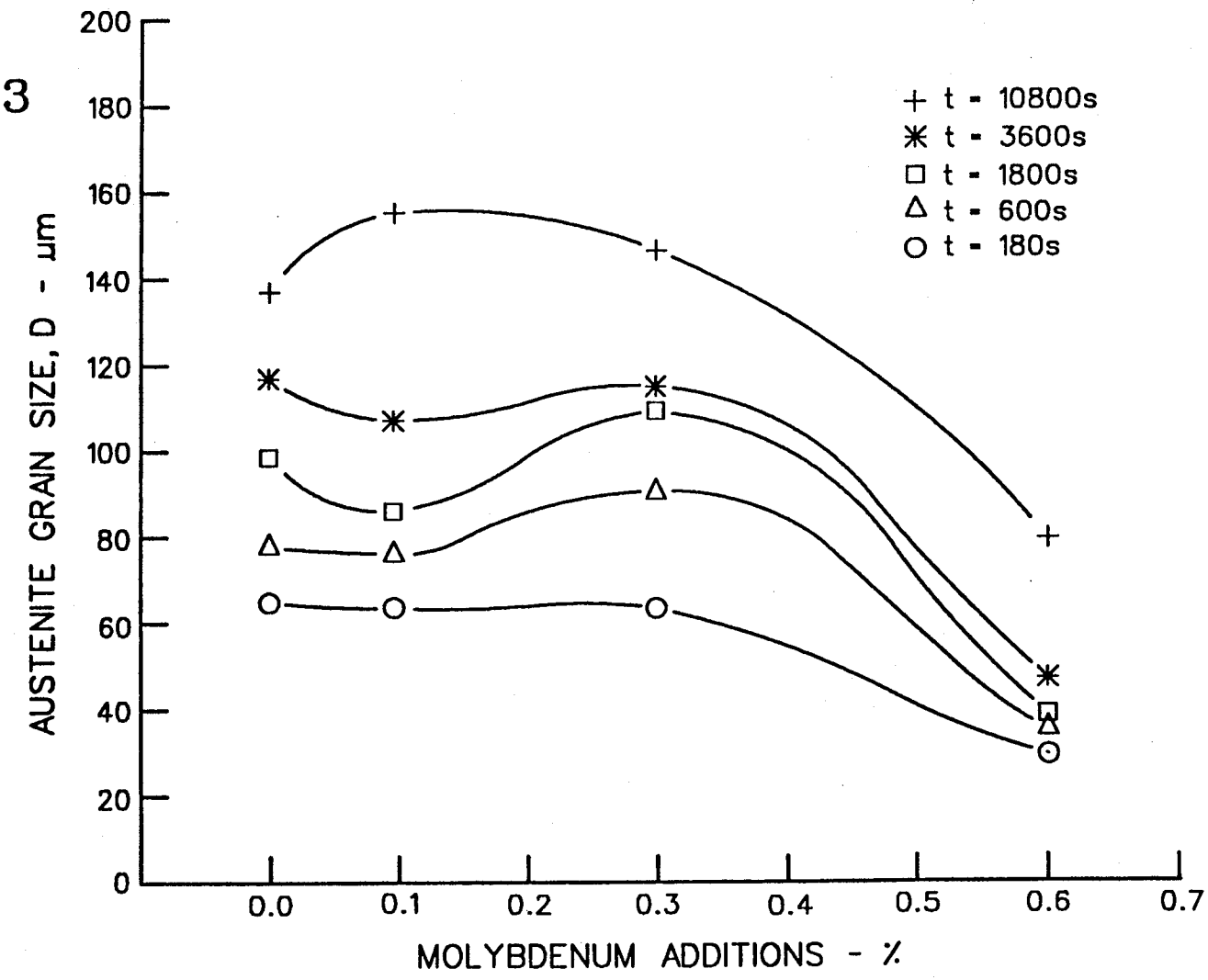
FIG. 3 is a graph of austenite grain size as a function of molybdenum content.

The molybdenum content can vary from about 0.5 to about 1.75 percent. Molybdenum affects the structure of the austenite during conditioning. If the molybdenum content is below about 0.5 percent, the grain size of the austenite during conditioning prior to cooling and transformation is too large, resulting in a coarse ferrite grain size and low strength upon cooling. FIG. 3 is a graph of austenite grain size as a function of molybdenum content after reheating the steel to 1150° C. for various times (indicated in seconds), illustrating the reduction in grain size achieved with a sufficiently high molybdenum content. If the molybdenum content is too high, there may be molybdenum-based embrittlement at grain boundaries.

It was the practice in prior microalloyed steels used for forging applications to keep the molybdenum content very low, at about 0.2 percent, on the theory that molybdenum contributes to a reduction in toughness in the final product. The present approach demonstrates that the contribution of molybdenum to improved conditioning of the austenite through austenite grain size reduction provides a significant benefit not previously realized in this class of steels.

The niobium content can vary from about 0.01 to about 0.10 percent. Niobium contributes to the strengthening and toughness of the steel through the formation of niobium carbides, nitrides, and carbonitrides. Niobium also contributes to strengthening by lowering the bainite start temperature when the niobium is in solution. If the niobium content is less than about 0.01 percent, insufficient niobium precipitates are formed to achieve acceptable toughness levels. If the niobium content is more than about 0.10 percent, the volume fraction of precipitates is too large, and there is a resulting reduction in toughness of the steel.

The manganese content can vary from about 0.5 to about 2.0 weight percent, and the chromium content can vary from about 0.3 to about 1.0 weight percent. Manganese and chromium affect phase formation during cooling, as may be seen in the continuous-cooling-transformation (CCT) diagram, generally by suppressing transformation temperatures and delaying the start of pearlite formation. The result is a fine microstructure including the ferrite grain size, and production of bainite rather than pearlite during cooling.

Figure 4:
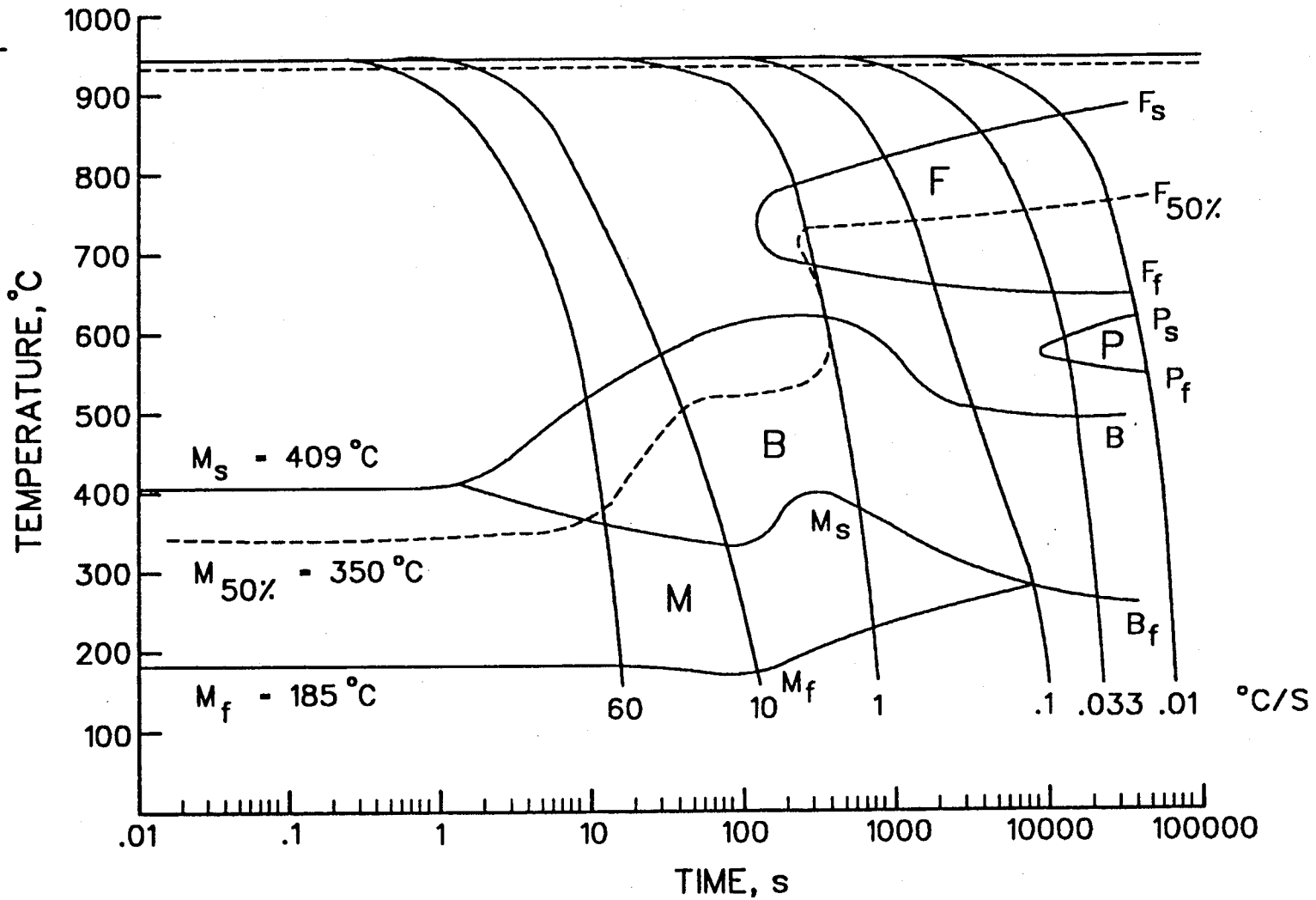
FIG. 4 is a continuous-cooling-transformation diagram for the steel of the invention.
Figure 5:
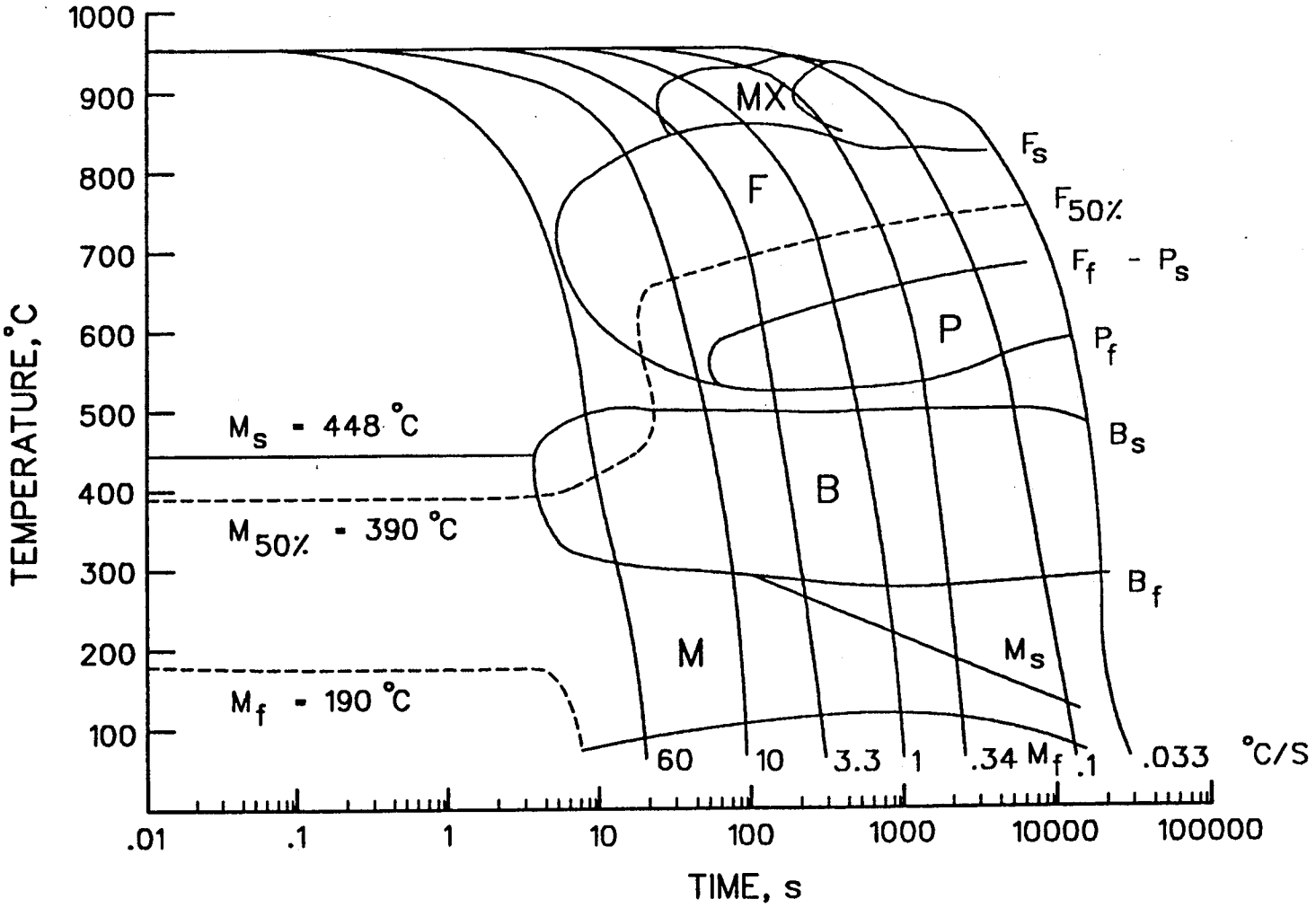
FIG. 5 is a continuous-cooling-transformation diagram for a steel having lower molybdenum and chromium than permitted by the invention.

FIGS. 4 and 5 illustrate the effect of chromium on the continuous cooling transformation diagram. The CCT diagram for the MPC steel is depicted in FIG. 4, while the CCT diagram for a comparable steel, except having only 0.1 percent molybdenum and 0.25 percent chromium, is depicted in FIG. 5. The start of pearlite formation is delayed in the steel of the invention, resulting in a microstructure that is primarily fine ferrite and fine lower bainite. Alloying elements such as molybdenum move the ferrite-start temperature to the right in the non-control rolling processes whose results are depicted in FIGS. 4 and 5.

Pearlite in the microstructure contributes to reduced toughness. The composition and processing of the present steel are selected to avoid or at least minimize the amount of pearlite present. In commercial practice a small amount of pearlite, such as less than 2 percent by volume, may unavoidably be present, particularly in the center of large sections, but care is taken to minimize its presence and effects.

The most preferred microstructure has fine grained ferrite, with a grain size of less than about 15 micrometers. The fineness of the microstructure contributes significantly to high strength and high toughness, and an increase above about 15 micrometers is not acceptable. The fine ferrite grain size originates in part with the well conditioned austenite having a fully recrystallized, fine grained, equiaxed structure.

The most preferred microstructure also preferably has fine lower bainite in preference to coarse upper bainite. The fine lower bainite in combination with the fine ferrite grain size promote good notch toughness in the final product.

Figure 6:
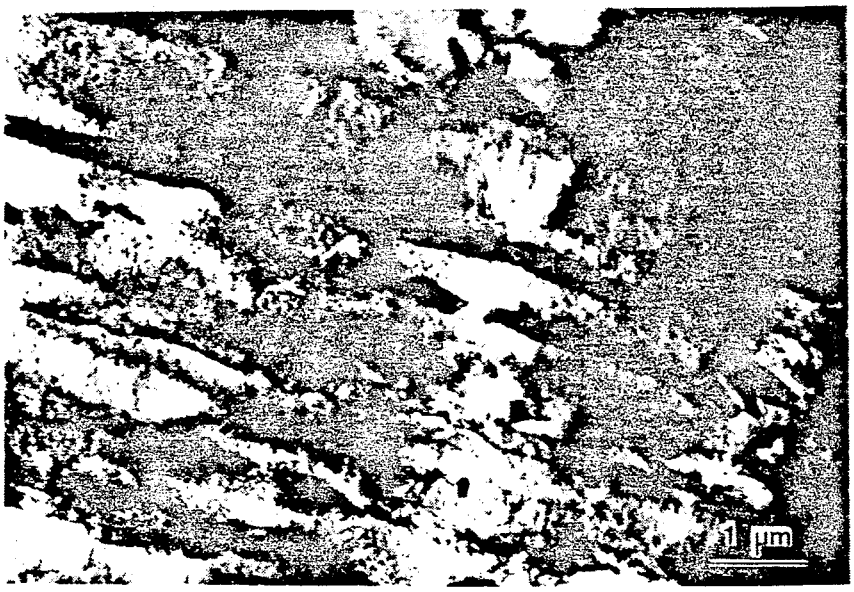
FIG. 6 is a micrograph (at 20,000X) of a steel having an upper bainite microstructure.

The bainite microstructure essentially has a two-phase microstructure composed of ferrite and iron carbide. Depending on the composition of the austenite and the cooling rate, there is a variation in the morphology of the resulting bainite. The resulting microstructures are referred to as upper bainite or lower bainite. FIG. 6 shows an example of the steel of the invention with an upper bainite microstructure. Upper bainite can be described as aggregates of ferrite laths that usually are found in parallel groups to form plate-shaped regions. The carbide phase associated with upper bainite is precipitated at the prior austenite grain boundaries (interlath regions), and depending on the carbon content, these carbides can form nearly complete carbide films between the lath boundaries, as shown in FIG. 6.

Figure 7:
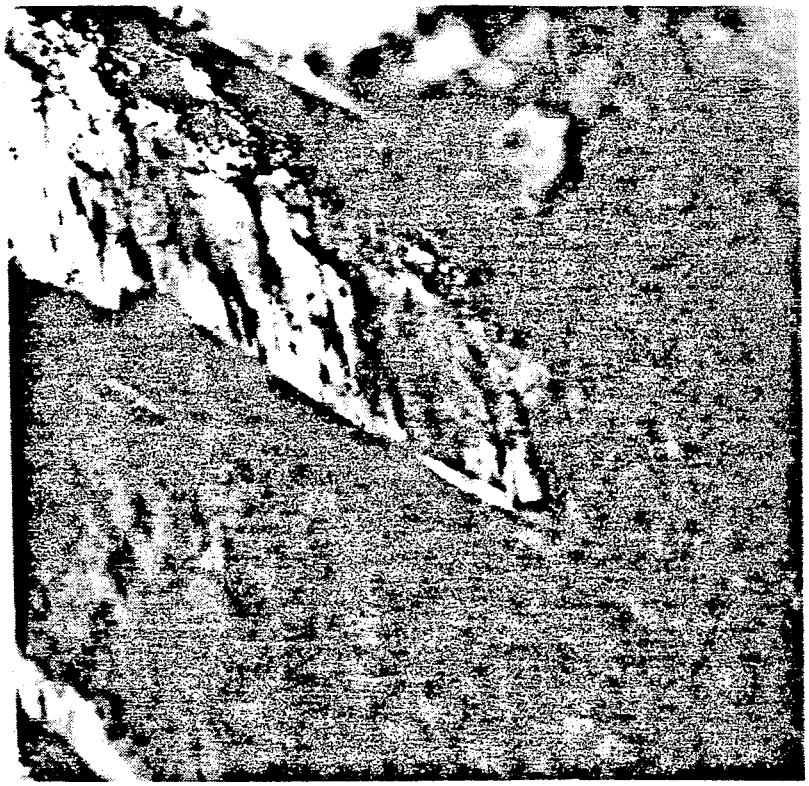
FIG. 7 is a micrograph (at 25,000X) of a steel having a lower bainite microstructure.

Lower bainite also consists of an aggregate of ferrite and carbides. The carbides precipitate inside of the ferrite plates. The carbide precipitates are on a very fine scale and in general have the shape of rods or blades. A typical example of lower bainite microstructure in a steel of the invention is illustrated in FIG. 7.

The sulfur content of the steel is selected depending upon the intended application of the steel. Manganese reacts with sulfur to form manganese sulfides, which act as crack initiation sites and reduce the toughness of the steel. On the other hand, these sulfides can contribute to the machinability of the steel through essentially the same mechanism. Inasmuch as other microstructural mechanisms, principally the fineness of the ferrite and bainite structure, are present to improve toughness, some sulfur is provided in those applications where machinability is desirable. For the hot forging and cold forming applications of interest, the sulfur content can vary from about 0.015 percent to about 0.020 percent. If the sulfur content is less than about 0.015 percent, the steel cannot be readily machined. If the sulfur content is more than about 0.020 percent, the toughness is reduced unacceptably. On the other hand, the steel can be used for other applications such as tire cord, where machinability is not required. In this instance, the sulfur is preferably reduced further, and most preferably to about 0.003 percent. In another application where free machining is desired, the sulfur content may be increased to from about 0.020 to about 0.060 percent to improve chip formation at a sacrifice in product toughness.

After the steel is prepared according to the invention, it is used in any of several applications. In one potential application of particular interest, the steel replaces a medium carbon steel in the fabrication by cold forming of a steering bracket. When a medium carbon 1038 steel is used to form the bracket, a number of heat treatments are required, which are not needed when the controlled rolled, and air cooled preferred steel of the invention is used. The following Table I compares the fabrication steps required for the two steels in making the bracket, and the resulting properties:

TABLE I

| 1038 Steel | Present Steel |
|---|---|
| Hot roll to bar | Control roll to bar |
| Spheroidize anneal | (no anneal) |
| Clean and lubricate | Clean and lubricate |
| Two stage heading | Two stage heading |
| Stress relieve | (no stress relieve) |
| Bend, coin & punch | Bend, coin, & punch |
| Quench & temper | (no quench & temper) |
| Final Properties: | |
| Yield: 100 ksi | 150 ksi |

TABLE I-continued

| 1038 Steel | Present Steel |
|---|---|
| Fatigue limit | |
| 89,000 cycles | 162,000 cycles |
| Toughness: 60 ft-lb | 70 ft-lb |

("ksi" is thousands of pounds per square inch, and "ft-lb" is foot pounds of energy absorbed.)

The present steel is slightly more expensive than the 1038 steel in that it contains more expensive alloying elements, and requires mill control rolling procedures. This cost is more than offset by the elimination of three heat treatments during the fabrication operation, resulting in a less costly final part. Moreover, the properties of the part made with the present steel are superior to those of the part made with the plain carbon steel.

The following examples are presented to illustrate aspects of the invention, but should not be taken as limiting the invention in any respect.

EXAMPLE 1

The preferred MPC steel of the invention was comparatively tested against two prior steels used for forging applications. The results obtained for the steels are as follows:

TABLE II

| Steel | YS (ksi) | TS (ksi) | %RA | CVN, ft-lb 0F | CVN, ft-lb 75F |
|---|---|---|---|---|---|
| 1045/WQ | 82 | 123 | 40 | 12 | 20 |
| 10V45/HR | 86 | 125 | 29 | 4 | 12 |
| MPC/WQ | 114 | 138 | 63 | 33 | 53 |
| MPC/AC | 62 | 97 | 61 | 46 | 68 |

(WQ is water quenched, HR is hot rolled, and AC is air cooled. YS is yield strength, TS is tensile strength, RA is percentage reduction in area, and CVN is Charpy V-notch toughness at the indicated temperatures.)

The steel of the invention in the water quenched condition is superior to the prior steels in all respects. In the air cooled condition, it has lower strength properties but much better toughness properties. For some applications, the combination of properties offered by the air cooled steel of the present invention may be preferable to those of the prior steels.

EXAMPLE 2

The preferred MPC steel of the invention was comparatively tested against hot rolled SAE grade 1541 steel in the manufacture of a centerlink for automotive applications. The preferred steel of the invention was control rolled, and could be cleaned and coated, cold drawn, extruded, bent, coined, drilled and magnaflux inspected. The SAE grade 1541 steel was conventionally rolled, spheroidize annealed (a step not required or used for the preferred steel of the invention), and could be cleaned and coated, cold drawn, extruded, bent, coined, drilled, and magnaflux inspected.

The steel of the invention had a yield strength of 112,000 psi, a tensile strength of 120,000 psi, a Charpy V-Notch value at room temperature of 60–80 foot-pounds, and no split rejects in forming a number of the parts. By contrast, the SAE grade 1541 steel had a yield strength of 100,000 psi, a tensile strength of 110,000 psi, a Charpy V-Notch value at room temperature of only 15–17 foot-pounds, and 8 percent split rejects in forming a number of the parts.

EXAMPLE 3

The preferred MPC steel of the invention was comparatively tested against grades HSLA 90 and 1541H in the hot forging of lower control arms for automotive applications. Each steel was conventionally hot rolled and hot forged, and air cooled. The HSLA 90 and steel of the invention received no further heat treatment, while the grade 1541H steel was quenched and tempered.

The steel of the invention had a yield strength of 122,000 psi, a tensile strength of 152,000 psi, a Charpy V-notch value at room temperature of 51–59 foot-pounds, and failed in fatigue at about 250,000 cycles. The HSLA 90 steel had a yield strength of 105,000 psi, a tensile strength of 133,000 psi, and a Charpy V-notch value at room temperature of 21–22 foot-pounds. The grade 1541H steel, which was quenched and tempered, had a yield strength of 116,000 psi, a tensile strength of 135,000 psi, a Charpy V-notch value at room temperature of 45–68 foot-pounds, and failed in fatigue at about 80,000 cycles.

The steel of the invention exhibited significantly better strength and toughness values than the HSLA 90 steel, and significantly better strength than the grade 1541 steel, with comparable toughness values.

The present invention therefore provides a versatile steel material that can be used in a wide variety of applications without post rolling heat treatments. Although particular embodiments of the invention have been described in detail for purposes of illustration, various modifications may be made without departing from the spirit and scope of the invention. Accordingly, the invention is not to be limited except as by the appended claims.

What is claimed is:

1. A steel having a composition consisting essentially of, in weight percent, from about 0.05 to about 0.15 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities, and a microstructure consisting essentially of from about 15 to about 90 volume percent ferrite and the remainder lower bainite.

2. A steel having a composition consisting essentially of, in weight percent, from about 0.05 to about 0.35 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities, and a microstructure consisting essentially of from about 70 to about 90 volume percent lath martensite and from about 10 to about 30 volume percent lower bainite.

3. The steel of claim 2, wherein the carbon content is from about 0.08 to about 0.15 percent.

4. The steel of claim 2, wherein the carbon content is from about 0.15 to about 0.25 percent.

5. A process for preparing a steel article, comprising the steps of:

providing a steel composition consisting essentially of, in weight percent, from about 0.05 to about 0.15 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities;

hot working the steel in the austenite range; and cooling the steel at a rate sufficient to produce a ferritic-bainitic microstructure with an average ferrite grain size of less than about 15 micrometers.

6. The process of claim 5, wherein the hot working is achieved by control rolling.

7. The process of claim 5, including the additional step, after the step of cooling, of cold working the steel.

8. A process for preparing a steel article, comprising the steps of:

providing a steel composition consisting essentially of, in weight percent, from about 0.05 to about 0.35 percent carbon, from about 0.5 to about 2.0 percent manganese, from about 0.5 to about 1.75 percent molybdenum, from about 0.3 to about 1.0 percent chromium, from about 0.01 to about 0.1 percent niobium, from about 0.003 to about 0.06 percent sulfur, from about 0.003 to about 0.015 percent nitrogen, from about 0.2 to about 1.0 percent silicon, balance iron plus conventional impurities;

hot working the steel in the austenite range; and hot forging the steel.

9. The process of claim 8, wherein the steel has a carbon content of from about 0.08 to about 0.15 percent.

10. The process of claim 8, including the additional step, after the step of hot forging, of induction hardening the surface of the hot forged article.

11. A steel prepared by the process of claim 5.

12. A steel prepared by the process of claim 6.

13. A steel prepared by the process of claim 7.

14. A steel prepared by the process of claim 8.

15. A steel prepared by the process of claim 9.

16. A steel prepared by the process of claim 10.

* * * * *